US008064809B2

(12) United States Patent
Yamaguchi et al.

(10) Patent No.: US 8,064,809 B2
(45) Date of Patent: Nov. 22, 2011

(54) IMAGE FORMING APPARATUS WITH INTERMEDIATE TRANSFER BELT SPEED DETECTION UNIT

(75) Inventors: Jun Yamaguchi, Fujisawa (JP); Hidehiko Kinoshita, Kashiwa (JP); Masaaki Moriya, Moriya (JP); Kenji Fukushi, Kashiwa (JP); Yousuke Hata, Matsudo (JP)

(73) Assignee: Canon Kabushiki Kaisha, Tokyo (JP)

( * ) Notice: Subject to any disclaimer, the term of this patent is extended or adjusted under 35 U.S.C. 154(b) by 738 days.

(21) Appl. No.: 12/182,919

(22) Filed: Jul. 30, 2008

(65) Prior Publication Data

US 2009/0034992 A1 Feb. 5, 2009

(30) Foreign Application Priority Data

Jul. 31, 2007 (JP) ..... 2007-199893

(51) Int. Cl.
*G03G 15/00* (2006.01)
*G03G 15/01* (2006.01)
*G03G 15/16* (2006.01)

(52) U.S. Cl. ..... 399/301; 399/66

(58) Field of Classification Search ..... 399/301, 399/302, 66, 394, 396; 347/116
See application file for complete search history.

(56) References Cited

U.S. PATENT DOCUMENTS 5,875,380 A * 2/1999 Iwata et al. ..... 399/301
7,221,894 B2 * 5/2007 Kishi ..... 399/302
2005/0053388 A1 3/2005 Yokoyama et al.
2005/0214037 A1 9/2005 Kishi
2007/0231022 A1 * 10/2007 Yokoyama et al. ..... 399/301

FOREIGN PATENT DOCUMENTS

JP 09-175687 7/1997
JP 2005-156877 6/2005
JP 2005-156877 A 6/2005

OTHER PUBLICATIONS

Machine translation of JP 2005-156877 dated Jun. 6, 2011.*

* cited by examiner

*Primary Examiner* — Sophia S Chen
(74) *Attorney, Agent, or Firm* — Canon USA Inc IP Division

(57) ABSTRACT

An image forming apparatus includes an endless belt type transfer member configured to carry an image formed with developer of a plurality of colors, a drive roller configured to drive the transfer member by rotating while contacting the transfer member, a first detection unit configured to detect a mark provided on the transfer member, a second detection unit configured to detect the mark at a position different from the position of the first detection unit in a conveyance direction of the transfer member, and a correction unit configured to correct a conveyance speed of the transfer member using a difference between respective times at which the first and second detection units detect the mark. The first and second detection units are located such that an interval between respective positions at which the first and second detection units detect the mark is an integral multiple of a perimeter of the drive roller.

3 Claims, 6 Drawing Sheets

IMAGE FORMING APPARATUS WITH INTERMEDIATE TRANSFER BELT SPEED DETECTION UNIT

BACKGROUND OF THE INVENTION

1. Field of the Invention

The present invention relates to an image forming apparatus and an image forming method that are capable of accurately detecting the conveyance speed of an intermediate transfer belt.

2. Description of the Related Art

Generally, in an image forming apparatus, it is desirable to form an image at a desired position on a sheet. In the case of a color image forming apparatus that can form images of a plurality of colors, images of a plurality of colors are superposed on one another to form a color image. Accordingly, in order to reduce color misregistration, it is desirable to match the image formation positions of images of a plurality of colors. In an intermediate transfer type color image forming apparatus, toner images of a plurality of colors are formed on respective photosensitive drums. The toner images are sequentially transferred onto an intermediate transfer belt, and the multicolor images on the intermediate transfer belt are collectively transferred and fixed on a sheet, so that a color image can be obtained.

In such an intermediate transfer type color image forming apparatus, it is necessary to accurately superpose toner images of respective colors formed on the photosensitive drums on the intermediate transfer belt. However, if the speed of the intermediate transfer belt varies, misregistration of toner images of respective colors may occur. To solve the problem, techniques to detect the speed of an intermediate transfer belt and to correct the operating state of an apparatus have been proposed.

For example, Japanese Patent No. 3344614 discusses a technique to separately dispose two sensors with some distance in a conveyance direction of an intermediate transfer belt. The two sensors detect a mark, and, based on a time interval of the detection of the mark, the conveyance speed of the intermediate transfer belt is detected. Based on the detected conveyance speed, the driving speed of the intermediate transfer belt is controlled such that the conveyance speed becomes constant.

Further, in Japanese Patent Application Laid-Open No. 2005-156877, two sensors detect a mark at some time intervals. Based on the time intervals, the conveyance speed of an intermediate transfer belt is detected, and the conveyance speed obtained after the correction of color misregistration is stored. Then, a correction is performed to match the subsequent conveyance speed of the intermediate transfer belt with the stored conveyance speed.

However, the above-described techniques do not mention a specific value and reason about the interval of two sensors for detecting the conveyance speed of the intermediate transfer belt. In the case where the conveyance speed of an intermediate transfer belt is detected using one mark provided on the intermediate transfer belt and two sensors separately disposed with a distance in a conveyance direction, if the distance between the two sensors is not appropriately managed, a large speed detection error may occur.

SUMMARY OF THE INVENTION

The present invention is directed to a technique to accurately detect the conveyance speed of an intermediate transfer belt.

According to an aspect of the present invention, an image forming apparatus includes an endless belt type transfer member configured to carry an image formed with developer of a plurality of colors, a drive roller configured to drive the endless belt type transfer member by rotating while contacting the endless belt type transfer member, a first detection unit configured to detect a mark provided on the endless belt type transfer member, a second detection unit configured to detect the mark at a position different from the position of the first detection unit in a conveyance direction of the endless belt type transfer member, and a correction unit configured to correct a conveyance speed of the endless belt type transfer member using a difference between respective times at which the first detection unit and the second detection unit detect the mark. The first detection unit and the second detection unit are located such that an interval between respective positions at which the first detection unit and the second detection unit detect the mark is an integral multiple of a perimeter of the drive roller.

Further features and aspects of the present invention will become apparent from the following detailed description of an exemplary embodiment with reference to the attached drawings.

BRIEF DESCRIPTION OF THE DRAWINGS

The accompanying drawings, which are incorporated in and constitute a part of the specification, illustrate an exemplary embodiment, features, and aspects of the invention and, together with the description, serve to explain the principles of the invention.

DETAILED DESCRIPTION OF THE EMBODIMENT

Various exemplary embodiments, features, and aspects of the invention will be described in detail below with reference to the drawings.

Figure 1:
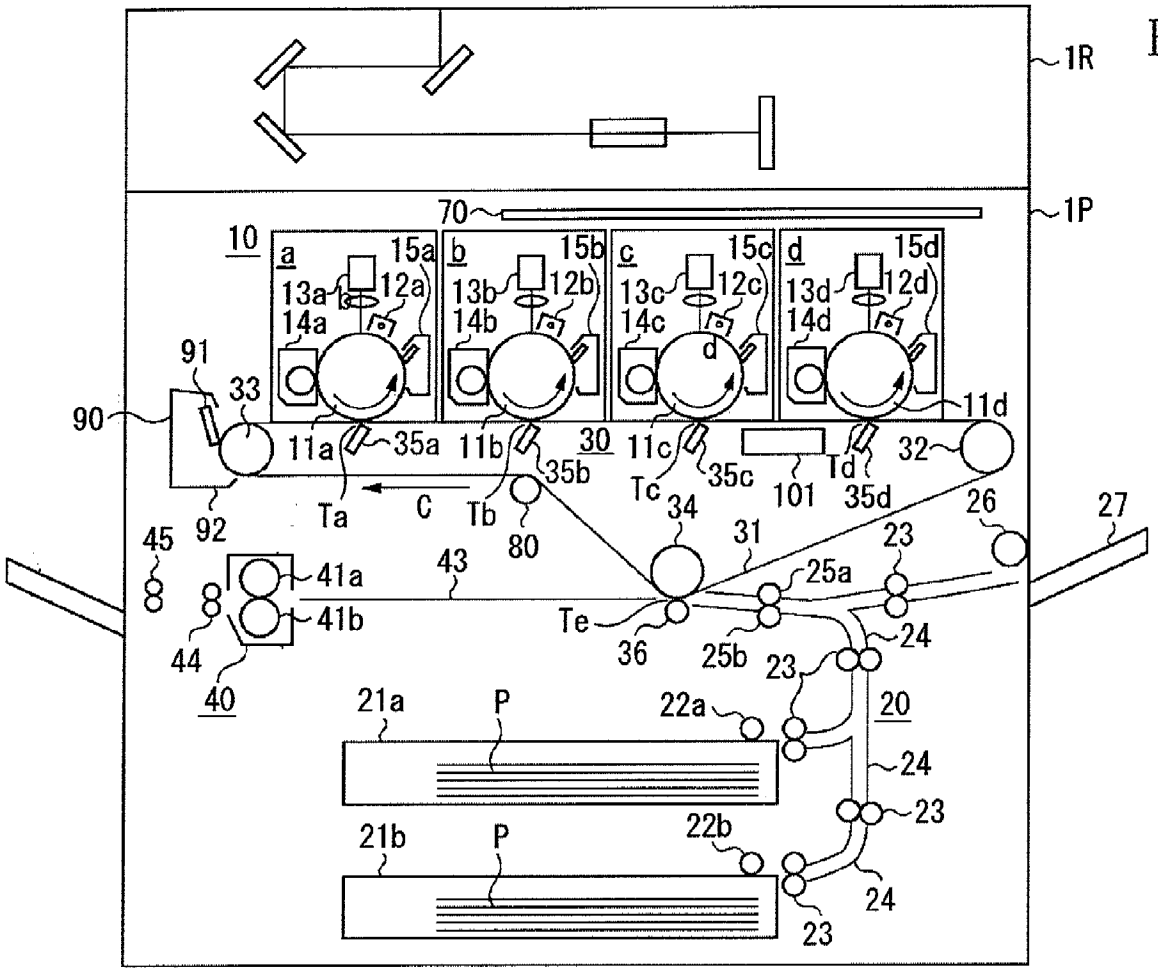
FIG. 1 is a block diagram illustrating a configuration of an image forming apparatus according to an exemplary embodiment of the present invention.

FIG. 1 is a cross-sectional view illustrating essential portions of an image forming apparatus according to an exemplary embodiment of the present invention. The image forming apparatus illustrated in FIG. 1 includes an image input unit 1R and an image output unit 1P. The image input unit 1R reads an image on an original and generates digital image data. The image output unit 1P includes an image forming unit 10, a feeding unit 20, an intermediate transfer unit 30, a fixing unit 40, and a control unit 70. The image forming unit 10 includes four stations a, b, c, and d that have a similar structure.

Each of the four stations a, b, c, and d is described in detail below. In the image forming unit 10, photosensitive drums 11*a*, 11*b*, 11*c*, and 11*d* (hereinafter, referred to as photosensitive drums 11) are pivotally supported at centers. The photosensitive drums 11 are driven to rotate in the direction of an arrow indicated in FIG. 1 and function as an image bearing member. Primary charging devices 12*a* to 12*d* (hereinafter, referred to as primary charging devices 12), optical systems 13*a* to 13*d* (hereinafter, referred to as optical systems 13), and development devices 14*a* to 14*d* (hereinafter, referred to as development devices 14) are disposed to face outer circumference surfaces of respective photosensitive drums 11 in the rotation directions.

The primary charging devices 12 apply an even amount of electric charge to the surfaces of the photosensitive drums 11. Then, the optical systems 13 expose the photosensitive drums 11 with light beams, such as laser beams, that are modulated according to a recording image signal. On the surfaces of the photosensitive drums 11, electrostatic latent images are formed. The electrostatic latent images are developed as toner images by the development devices 14, which contain developer of four colors of yellow, cyan, magenta, and black, respectively. At downstream sides of primary transfer areas where the developed toner images are transferred to an intermediate transfer belt 31, toner that is not transferred on the intermediate transfer belt 31 and still remains on the photosensitive drums 11 is removed by cleaning devices 15*a*, 15*b*, 15*c*, and 15*d* (hereinafter, referred to as cleaning devices 15).

According to the above-described processes, the image formation using the toner is sequentially performed.

The feeding unit 20 includes cassettes 21*a* and 21*b*, which house a recording material P, and a manual feed tray 27. The feeding unit 20 further includes pickup rollers 22*a*, 22*b*, and 26, which feed the recording material P sheet by sheet from the cassette 21*a*, the cassette 21*b*, or the manual feed tray 27. The feeding unit 20 further includes pairs of feeding rollers 23 and feeding guides 24, which convey the recording material P fed from the pickup roller 22*a*, 22*b*, or 26 to registration rollers 25*a* and 25*b*. The feeding unit 20 further includes the registration rollers 25*a* and 25*b*, which feed the recording material P to a secondary transfer area Te at a timing synchronized with an image formation timing in the image forming unit 10.

The intermediate transfer unit 30 includes the intermediate transfer belt 31, which functions as an intermediate transfer member. The intermediate transfer belt 31 is wound onto a drive roller 32, a tension roller 33, a secondary transfer inner roller 34, and an outer roller 80. The drive roller 32 transmits a driving force to the intermediate transfer belt 31. The tension roller 33 applies an appropriate tension to the intermediate transfer belt 31 by an urging force of a spring (not shown). The secondary transfer inner roller 34 faces a secondary transfer outer roller 36 across the intermediate transfer belt 31. The outer roller 80 is located on the outside of the intermediate transfer belt 31. As a material that forms the intermediate transfer belt 31, for example, polyimide (PI), polyvinylidine fluoride (PVDF), or the like can be selected.

Figure 3:
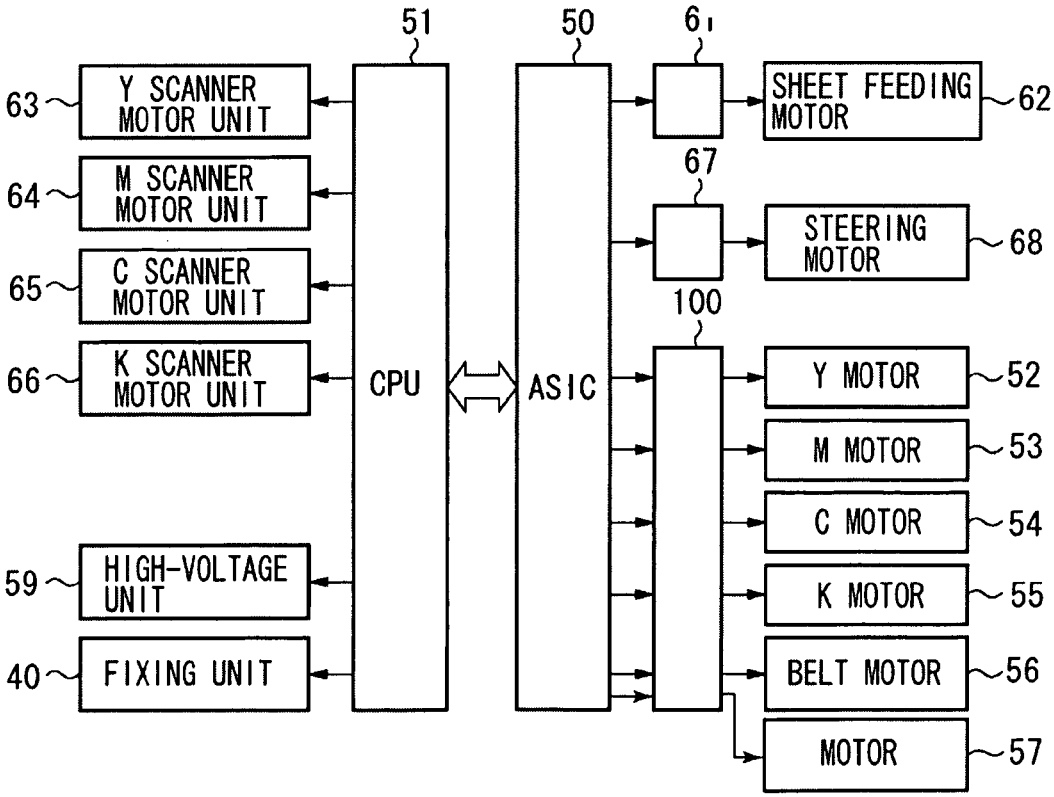
FIG. 3 is a block diagram illustrating a configuration of a control system according to an exemplary embodiment of the present invention.

The drive roller 32 is formed by coating a rubber (urethane or chloroprene) of several mm thickness on the surface of a metallic roller. The drive roller is formed to prevent a slip in a space between the intermediate transfer belt 31 and the drive roller 32. Between the drive roller 32 and the tension roller 33, a primary transfer plane is formed. The drive roller 32 is driven to rotate by an intermediate transfer drive motor 56 (FIG. 3). An intermediate transfer belt conveyance speed detection unit 101 is located near the intermediate transfer belt 31.

In primary transfer areas Ta to Td where the photosensitive drums 11*a* to 11*d* face the intermediate transfer belt 31, respectively, on the back side of the intermediate transfer belt 31, primary transfer devices 35*a* to 35*d*, which function as primary transfer units, are disposed. The secondary transfer roller 36 is located to face the secondary transfer inner roller 34, so that the secondary transfer area Te is formed.

At the downstream side of the secondary transfer area Te on the intermediate transfer belt 31, a cleaning device 90, which performs cleaning of the image formation surface of the intermediate transfer belt 31, is disposed. The cleaning device 90 includes a cleaner blade 91 and a waste toner box 92, which stores waste toner. As the material of the cleaner blade 91, polyurethane rubber or the like can be used.

The fixing unit 40 includes a fixing roller 41*a*, which internally includes a heat source, such as a halogen heater, and a pressure roller 41*b*, which presses the fixing roller 41*a*. The pressure roller 41*b* can include a heat source. The fixing unit 40 further includes a guide 43, an inner discharge roller 44, and an outer discharge roller 45. The guide 43 guides the recording material P to a nip portion between the fixing roller 41*a* and the pressure roller 41*b*. The inner discharge roller 44 and the outer discharge roller 45 discharge the recording material P having passed through the fixing roller 41*a* and the pressure roller 41*b* to the outside of the apparatus. The control unit 70 of the image forming apparatus includes a control board that controls operations of the mechanisms in the above-described units, a motor drive board, and the like.

Operation of the image forming apparatus is described below. When an image formation operation start signal is received, first, the pickup roller 22*a* feeds the recording material P sheet by sheet from the cassette 21*a*. Then, the pairs of feeding rollers 23 guide the recording material P through the feeding guides 24, and the recording material P is conveyed to the registration rollers 25*a* and 25*b*. At that time, the registration rollers 25*a* and 25*b* are stopped, and a leading edge of the recording material P collides against the nip portion between the registration rollers 25*a* and 25*b*. Then, the registration rollers 25*a* and 25*b* start to rotate at a timing the image forming unit 10 starts image formation. The timing of the start of the rotation of the registration rollers 25*a* and 25*b* is set such that the recording material P and the toner image that has been primary-transferred to the intermediate transfer belt 31 by the image forming unit 10 match each other in the secondary transfer area Te.

In the image forming unit 10, when an image formation start signal is received, a toner image formed on the photosensitive drum 11*d*, which is disposed at the most upstream side in the rotation direction of the intermediate transfer belt 31, is transferred onto the intermediate transfer belt 31 by the primary transfer device 35*d*, to which a high-pressure is applied. The toner image that has been primary-transferred to the intermediate transfer belt 31 is conveyed to the next primary transfer area. At that primary transfer area, an image formation is performed at a timing delayed by a period of time the toner image is conveyed in the image forming unit 10. Then, the next toner image is transferred to the intermediate transfer belt 31 in registration with the previous image. In the following steps, similar operations are repeated, and finally, a toner image of four colors is primary-transferred to the intermediate transfer belt 31.

When the recording material P enters the secondary transfer area Te and contacts the intermediate transfer belt 31, a high voltage is applied to the secondary transfer roller 36 in synchronization with a timing the recording material P passes through the secondary transfer area Te. The image of four colors formed on the intermediate transfer belt 31 according to the above-described process is transferred to the surface of the recording material P. The recording material P to which the toner image has been transferred is accurately guided by the conveyance guide 43 to the nip portion between the fixing roller 41*a* and the pressure roller 41*b* of the fixing unit 40. By the heat of the pair of rollers 41*a* and 41*b* in the fixing unit 40 and the pressure at the nip portion, the toner image is fixed to the surface of the recording material P. The recording material P to which the toner image has been fixed is conveyed by the inner discharge roller 44 and the outer discharge roller 45 to the outside of the apparatus.

The intermediate transfer belt 31 is supported from the inside by the drive roller 32, the secondary transfer inside roller 34, which functions as a secondary transfer unit, and the tension roller 33. The intermediate transfer belt 31 is also supported from the outside by the outer roller 80. The tension roller 33 is urged by a spring member (not shown) in the left-hand direction in FIG. 1 to apply appropriate tension to the intermediate transfer belt 31. The outer roller 80 is pivotally supported by a bearing (not shown) at the rear end part as viewed in FIG. 1. An alignment of the outer roller 80 can be adjusted by moving the front end part in the direction of an arrow C.

Figure 2:
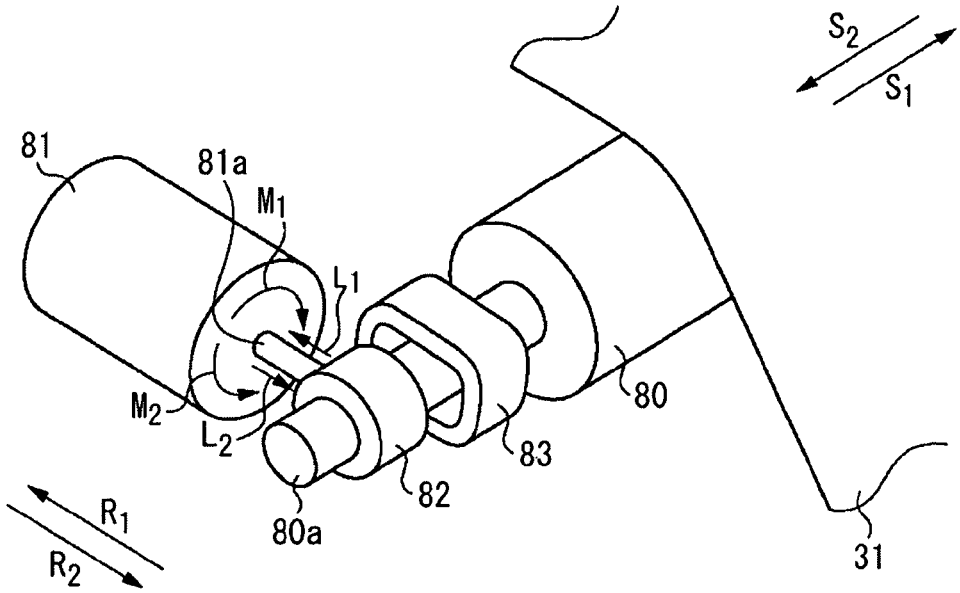
FIG. 2 is a perspective view illustrating an alignment adjustment mechanism for an intermediate transfer belt according to an exemplary embodiment of the present invention.

FIG. 2 is a perspective view illustrating an alignment adjustment mechanism for the outer roller 80. The shaft end part 80*a* at the front side of the outer roller 80 is pivotally supported to rotate by a lengthwise bearing 83, which is fixed to a side plate (not shown). The lengthwise bearing 83 has an elongate hole that fits to the shaft end part 80*a* only in one direction and allows moving only in the arrow C direction in FIG. 1. At the further outside of the longitudinal bearing 83, a bearing 82 is fit such that the bearing 82 can move in directions of arrows R1 and R2 (directions in parallel with the arrow C). A steering motor 81 is fixed to a side plane (not shown). At the front end of the steering motor 81, an output shaft 81*a*, to which a lead is provided, is mounted. The front end of the steering motor 81 is in contact with the bearing 82. At the opposite side of the bearing 82, a spring member (not shown) is provided. The spring member presses the bearing 82 against the output shaft 81*a*.

Accordingly, when the steering motor 81 rotates in an arrow M1 direction by a predetermined number of steps, the front end of the output shaft 81*a* moves in an arrow L1 direction by a predetermined amount. At the same time, the bearing 82 also moves in the arrow L1 direction by a predetermined amount. On the other hand, when the steering motor 81 rotates in an arrow M2 direction by a predetermined number of steps, the front end of the output shaft 81*a* moves in an arrow L2 direction by a predetermined amount. At the same time, the bearing 82 also moves in the arrow L2 direction by a predetermined amount. Thus, the shaft end part 80*a* of the front side of the outer roller 80 can be moved in the direction of the arrow R1 or R2. As a result, an alignment of the outer roller 80 can be adjusted.

In order to control a one-sided moving direction of the intermediate transfer belt 31, an alignment of the outer roller 80 is adjusted. If the shaft end part 80*a* of the front side of the outer roller 80 is moved in the arrow R1 direction, a one-sided moving force in the arrow S1 direction is generated in the intermediate transfer belt 31. If the shaft end part 80*a* of the front side of the outer roller 80 is moved in the arrow R2 direction, a one-sided moving force in the arrow S2 direction is generated in the intermediate transfer belt 31. If the alignment of the outer roller 80 is adjusted using the above-described characteristics, a one-sided moving force is actively generated in a direction to offset a one-sided moving force generated in the intermediate transfer belt 31 due to a strain of the apparatus body or the like. As a result, the intermediate transfer belt 31 can travel without deviating from a predetermined position.

FIG. 3 is a circuit block diagram illustrating the configuration of the image forming apparatus according to an exemplary embodiment of the present invention. As illustrated in FIG. 3, the image forming apparatus according to the exemplary embodiment includes an application specific integrated circuit (ASIC) 50, a central processing unit (CPU) 51, and drum drive motors 52, 53, 54, and 55, which drive the respective photosensitive drums 11. The image forming apparatus further includes a drive motor 56, which functions as an intermediate drive motor to drive the drive roller 32, and a fixing roller drive motor 57, which drives the fixing roller 41*a* in the fixing unit 40. The drive motors 52 to 57 are driven by a driver unit 100. The image forming apparatus further includes a sheet feeding motor 62, a sheet feeding motor driver 61, which drives the sheet feeding motor 62, scanner motor units 63, 64, 65, and 66 for respective colors, and a steering motor 68, which controls the amount of one-sided movement of the intermediate transfer belt 31. The image forming apparatus further includes a steering motor driver 67, which controls the steering motor 68, and a high-voltage unit 59.

The ASIC 50 controls the drum drive motors 52 to 55, the drive motor 56, the sheet feeding motor 62, the steering motor 68, and the fixing roller drive motor 57. The CPU 51 controls the scanner motor units 63 to 66, the high-voltage unit 59, and the fixing unit 40.

Figure 4:
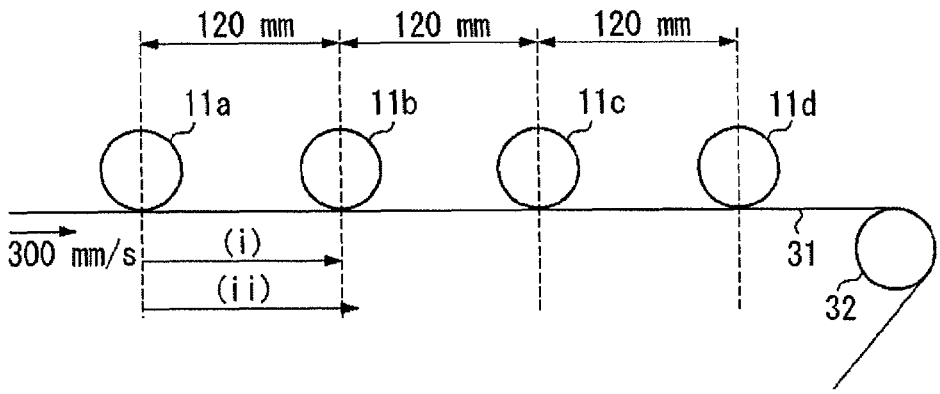
FIG. 4 is a view illustrating the occurrence of color misregistration due to belt speeds according to an exemplary embodiment of the present invention.

FIG. 4 is a view illustrating a positional relationship among the photosensitive drums 11*a* to 11*d*, the intermediate transfer belt 31, and the drive roller 32 according to an exemplary embodiment of the present invention. A design value of the conveyance speed of the intermediate transfer belt 31 is, for example, 300 mm/s. An interval between adjacent ones of the photosensitive drums 11*a* to 11*d* is, for example, 120 mm. Accordingly, if all elements are configured according to the design values, an image transferred from the Y-drum arrives at the next M-drum, for example, after 0.4 seconds (120 mm÷300 mm/s) (i). In such a case, timings for writing images are delayed by 0.4 seconds for each color. Here, a case is considered in which the temperature in the image forming apparatus body increases and the diameter of the drive roller 32 expands. Since the angular speed of the drive roller 32 is constant, as the diameter of the drive roller 32 increases, the conveyance speed of the intermediate transfer belt 31 also increases. In such a case, a toner image transferred from the Y-drum passes over the transfer position on the M-drum after 0.4 seconds (ii). Similar operations are repeated on the C-drum and the K-drum. Then, color misregistration occurs.

Accordingly, in order to reduce color misregistration, it is important to always maintain a constant conveyance speed of the intermediate transfer belt 31. If the angular speed of the drive roller 32 for the intermediate transfer belt 31 is constant, an alternating current (AC) component may be generated in the speed of the intermediate transfer belt 31 due to any eccentricity of the drive roller 32. The color misregistration due to the AC component can be canceled by making a pitch between the drums equal to a perimeter of the drive roller 32. Accordingly, in the present exemplary embodiment, a correction configuration to reduce a direct current (DC) speed variation of the intermediate transfer belt 31 can be provided.

Figure 5:
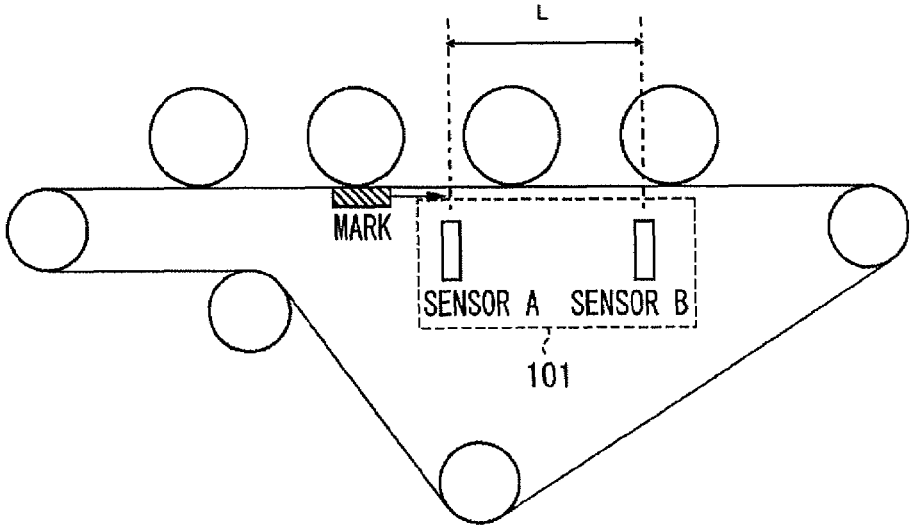
FIG. 5 is a view illustrating a configuration of a transfer belt speed detection unit according to an exemplary embodiment of the present invention.

FIG. 5 is a view illustrating the configuration of the intermediate transfer belt conveyance speed detection unit 101 according to an exemplary embodiment of the present invention. A reflective mark is provided on the back side of the intermediate transfer belt. The reflective mark has a reflection characteristic different from that of the intermediate transfer belt, and the reflective mark easily reflects diffusely. The reflective mark can be detected by a sensor A, which functions as a first detection unit, and a sensor B, which functions as a second detection unit, provided in the intermediate transfer belt conveyance speed detection unit 101. Each of the sensor A and sensor B is an optical reflection sensor that includes a light emitting portion and light receiving portion. Then, each of the sensor A and sensor B is located such that a line that connects the light emitting portion and the light receiving portion is orthogonal to the conveyance direction of the intermediate transfer belt.

Figure 9:
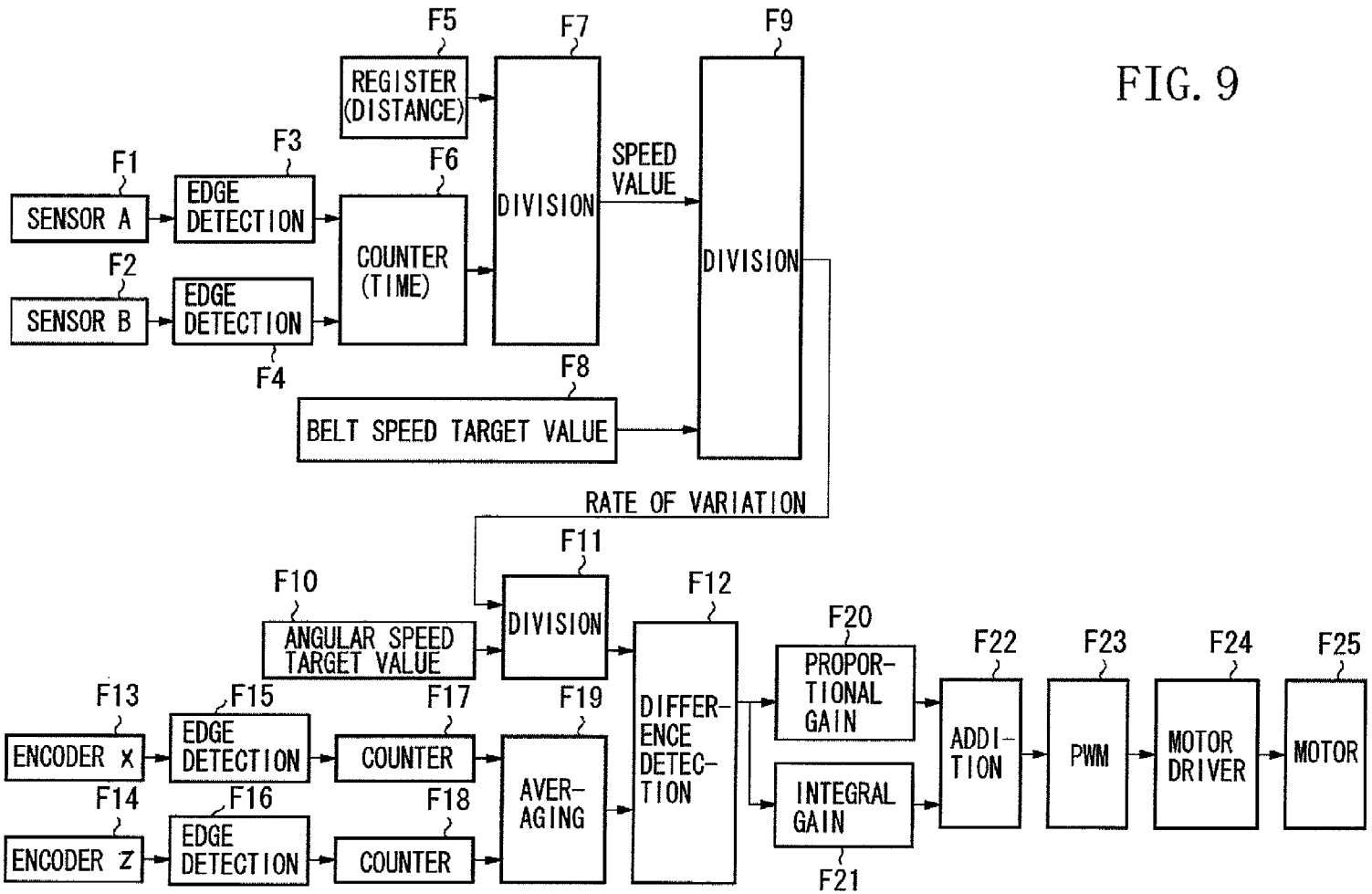
FIG. 9 is a control block diagram illustrating a transfer belt speed detection unit according to an exemplary embodiment of the present invention.

The conveyance speed of the intermediate transfer belt can be calculated by measuring a time T from the detection of the mark using the sensor A to the detection of the mark using the sensor B and dividing a distance L from the sensor A to the sensor B by the time T. Thus, speed V=distance L/time T. The speed detection and the operation to control a motor speed is described with reference to FIG. 9. In FIG. 9, F1 and F2 indicate the above-described sensor A and sensor B. An edge detection F3 and an edge detection F4 detect rising edges of outputs of the sensor A F1 and the sensor B F2. The detected edge signals are input to a counter F6. The counter F6 counts a time from a rising edge of output of the sensor A F1 to a rising edge of output of the sensor B F2 using a clock (20 MHz) (not shown). A register F5 stores a constant that indicates a distance. A division F7 divides the value in the register F5 by the value in the counter F6 to calculate a speed value. A division F9 divides the detected speed value by a belt speed target value F8 to calculate a rate of variation of the target speed.

Speed control for maintaining the angular speed of a transfer belt drive roller is described below. An encoder X F13 and an encoder Z F14 are rotary encoders that detect a slit of a code wheel located coaxial with the transfer belt drive roller to detect the rotation angular speed of the drive roller. By disposing the encoder X and the encoder Z to face each other, an eccentric component of the code wheel can be removed. Edge detections F15 and F16 detect edges of encoder signals, and counters F17 and F18 measure each edge interval time. An averaging F19 averages the two counted results and calculates a speed detection value. Normally, a difference detection F12 calculates an error between the speed detection value and an angular speed target value E F10 obtained with reference to the encoders, and sets the calculated error as a difference. However, in the present exemplary embodiment, a division F11 divides the angular speed target value E by the rate of variation calculated in the division F9. Accordingly, for example, if it is detected that the belt speed is higher than a target value by 1%, the angular speed target value E is decreased by such a difference to maintain the belt speed constant. The value calculated to detect a difference in the difference detection F12 is multiplied by a proportional gain F20 and multiplied by an integral gain F21. An addition F22 adds the proportional gain F20 value and the integral gain F21 value together. The added value is transmitted to a pulse width modulation (PWM) signal generator F23 to generate a PWM signal. The PWM signal is input to a motor driver F24 to drive a transfer belt drive motor F25. Then, the series of belt speed control ends.

Figure 6:
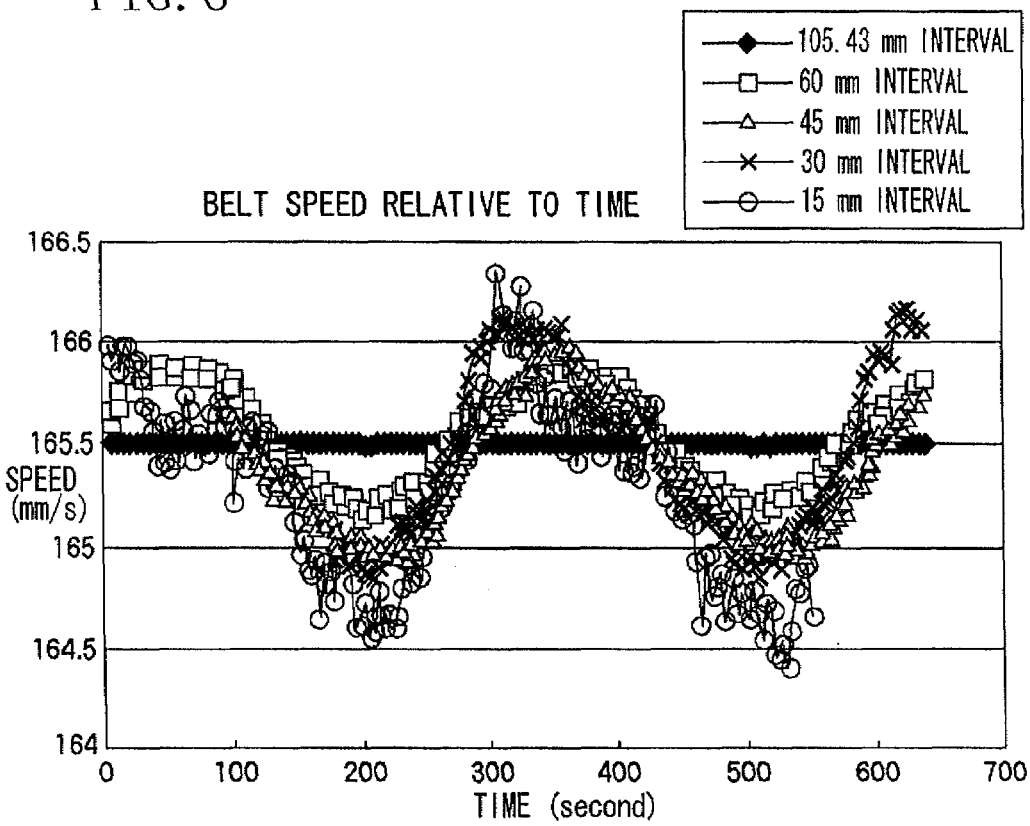
FIG. 6 is a view illustrating actual speeds measured by a transfer belt speed detection unit according to an exemplary embodiment of the present invention.

However, the interval between the sensor A and sensor B and the distance L require special attention. FIG. 6 is a graph illustrating speeds detected in the case where the distance L is variously changed. From the graph, it is understood that amplitudes of the detected speeds depend on the sensor interval distances L. If the distance L is short, the amplitude is large. When the distance L is set equal to the perimeter (105.43 mm) of the intermediate transfer belt drive roller, the amplitude becomes minimum.

Figure 7:
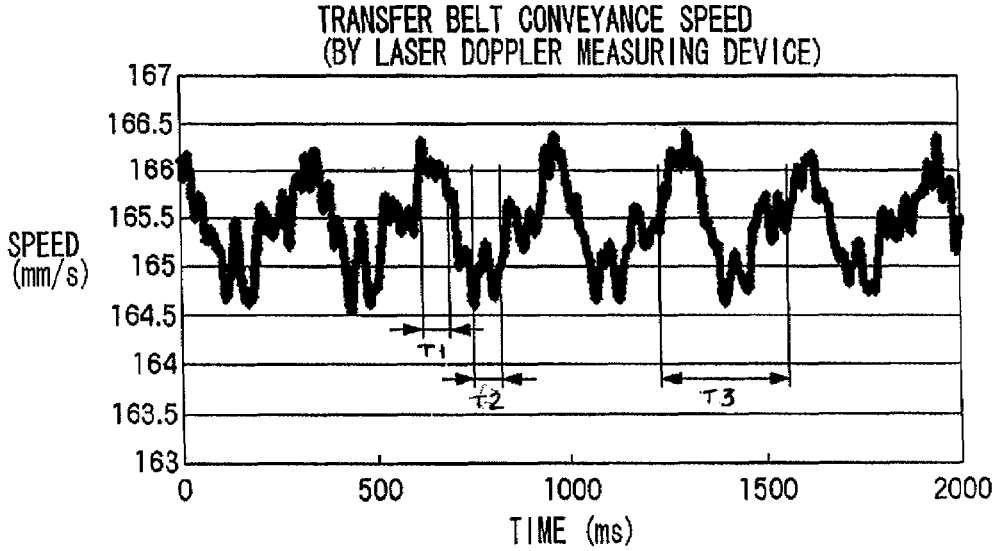
FIG. 7 is a view illustrating speed values of a transfer belt according to an exemplary embodiment of the present invention.

The reason can be described with reference to FIG. 7. FIG. 7 is a view illustrating measured results in the case where the speeds of the intermediate transfer belt are measured by a laser Doppler measuring device when the intermediate transfer belt is driven under the same conditions as those in FIG. 6. In FIG. 7, amplitude appears at a period of 350 ms. This period corresponds to one rotation period of the intermediate transfer belt drive roller. Accordingly, it can be considered that an AC amplitude of about ±1 mm/s that is observed in the graph in FIG. 6 is caused by an eccentricity of the intermediate transfer belt drive roller. Because a speed at a part such as a period T1 in FIG. 7 is to be measured if the distance between the sensors is short, it is determined that the speed is high. Further, if the detection is performed at a part such as a period T2, it is determined that the speed is low. On the other hand, as shown in a period T3, if the distance between the sensors is set equal to the length of the perimeter of the drive roller, speeds in one perimeter of the drive roller are measured. Then, the valley and the mountain cancel out each other, so that only a DC component can be measured.

Figure 8A:
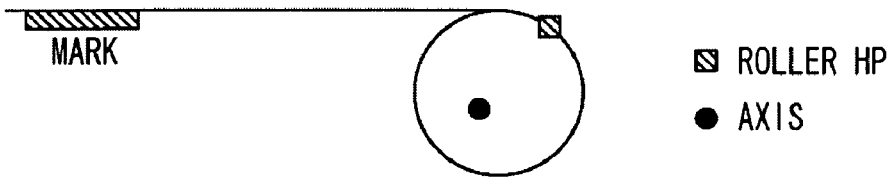
FIGS. 8A to 8C are views illustrating phases of a mark and a intermediate transfer belt drive roller according to an exemplary embodiment of the present invention.
Figure 8B:
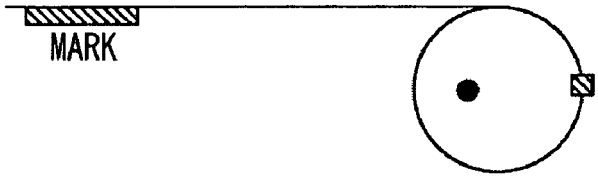
Figure 8C:
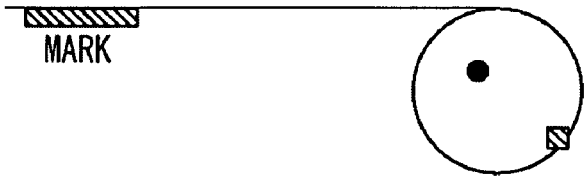

The reason why the detected speeds vary according to the distance L between the sensors as illustrated in FIG. 6 is described below with reference to FIGS. 8A to 8C. FIGS. 8A to 8C are views illustrating the intermediate transfer belt drive roller and a part of the intermediate transfer belt. The diameter of the intermediate transfer belt drive roller is, for example, 33.56 mm±0.025 mm. The length of the intermediate transfer belt is, for example, 527.522 mm±1 mm. Thus, the intermediate transfer belt has a length of, for example, 5.003725 times the perimeter of the intermediate transfer belt drive roller. As described above, the length of the intermediate transfer belt is not an exact integral multiple of the perimeter of the intermediate transfer belt drive roller. Accordingly, as illustrated in FIG. 8A, in a phase of the drive roller when the mark is detected first, the drive roller drives the belt in a state where the diameter is long. Accordingly, the speed is high. Then, after a certain period of time, if the phase is observed, even if the mark arrives at the same position, because the perimeter of the belt is not an exact integral multiple of the perimeter of the drive roller, the phase differs from the previous phase, and the phase is observed at a time the speed of the belt is low (FIG. 8B). Similarly, in the case of FIG. 8C, the phase further turns, and the belt speed is decreased. As described above, the phase turns at about five minutes, and the long-period amplitude illustrated in FIG. 6 occurs. In FIGS. 8A to 8C, ROLLER HP denotes a rough indication of the phase, and actually, the home position is not indicated. However, from FIG. 6, it is understood that the long-period amplitude can be substantially eliminated by setting the distance between the sensors equal to the perimeter of the drive roller (the graph of 105.43 mm interval).

As described above, in the present exemplary embodiment, in an apparatus that is provided with a mark on an intermediate transfer belt and measures the speed of the intermediate transfer belt by detecting the mark using two sensors, a distance between the two sensors is set equal to an integral multiple of the perimeter of a drive roller. Accordingly, only a DC speed variation of the intermediate transfer belt can be measured without detecting a speed variation due to any eccentricity of the intermediate transfer belt drive roller. Using the measured value, a feedback is performed to a target value of the conveyance speed of the transfer belt, and the drive roller, which conveys the transfer belt, can be controlled according to the corrected target value. Thus, a DC variation of the conveyance speed of the transfer belt can be reduced. Accordingly, color misregistration, which may occur when visible images formed by a plurality of image forming units are transferred in a superposed fashion, can be reduced.

In the above-described exemplary embodiment, an electrophotographic image forming apparatus is described as an example. However, exemplary embodiments of the present invention can be applied to any image forming apparatus that uses an intermediate transfer belt.

While the present invention has been described with reference to the exemplary embodiment, it is to be understood that the invention is not limited to the disclosed exemplary embodiment. The scope of the following claims is to be accorded the broadest interpretation so as to encompass all modifications, equivalent structures, and functions.

This application claims priority from Japanese Patent Application No. 2007-199893 filed Jul. 31, 2007, which is hereby incorporated by reference herein in its entirety.

What is claimed is:

1. An image forming apparatus comprising:

an endless belt type transfer member configured to carry an image formed with developer of a plurality of colors;

a drive roller configured to drive the endless belt type transfer member by rotating while contacting the endless belt type transfer member;

a first detection unit configured to detect a mark provided on the endless belt type transfer member;

a second detection unit configured to detect the mark at a position different from the position of the first detection unit in a conveyance direction of the endless belt type transfer member; and a correction unit configured to correct a conveyance speed of the endless belt type transfer member using a difference between respective times at which the first detection unit and the second detection unit detect the mark, wherein the first detection unit and the second detection unit are located such that an interval between respective positions at which the first detection unit and the second detection unit detect the mark is an integral multiple of a perimeter of the drive roller.

2. The image forming apparatus according to claim 1, wherein the correction unit includes a rotary encoder located coaxial with the drive roller and configured to detect a rotation angular speed of the drive roller, and is configured to control the rotation angular speed of the drive roller using the conveyance speed of the endless belt type transfer member detected by the first detection unit and the second detection unit and the rotation angular speed detected by the rotary encoder.

3. The image forming apparatus according to claim 1, wherein each of the first detection unit and the second detection unit includes an optical reflection sensor including a light emitting portion and a light receiving portion and is located such that a line connecting the light emitting portion and the light receiving portion is orthogonal to a conveyance direction of the endless belt type transfer member.

* * * * *